US007350646B2

(12) United States Patent
Durrant

(10) Patent No.: US 7,350,646 B2
(45) Date of Patent: Apr. 1, 2008

(54) BOWED CORNER PROTECTORS FOR PICTURE FRAMES

(76) Inventor: Säm Durrant, 114 Oak Street, Norwich, Norfolk NR3 36P (GB)

( * ) Notice: Subject to any disclaimer, the term of this patent is extended or adjusted under 35 U.S.C. 154(b) by 150 days.

(21) Appl. No.: 10/506,557

(22) PCT Filed: Mar. 3, 2003

(86) PCT No.: PCT/GB03/00881

§ 371 (c)(1),
(2), (4) Date: Sep. 2, 2004

(87) PCT Pub. No.: WO03/074387

PCT Pub. Date: Sep. 12, 2003

(65) Prior Publication Data

US 2005/0150810 A1 Jul. 14, 2005

(30) Foreign Application Priority Data

Mar. 2, 2002 (GB) ..... 0204963.3

(51) Int. Cl.
*B65D 81/02* (2006.01)
*A47B 95/00* (2006.01)

(52) U.S. Cl. ..... 206/586; 206/453; 248/345.1

(58) Field of Classification Search ..... 206/453, 206/521, 586, 597; 248/345.1; 49/462; 40/788

See application file for complete search history.

(56) References Cited

U.S. PATENT DOCUMENTS

| | | | | | |
|---|---|---|---|---|---|
| 3,030,728 | A | * | 4/1962 | Wesman | 248/345.1 |
| 3,451,169 | A | * | 6/1969 | Bell et al. | 49/462 |
| 3,936,025 | A | * | 2/1976 | Cass | 248/345.1 |
| 4,063,702 | A | * | 12/1977 | Wilde et al. | 248/345.1 |
| 4,443,508 | A | * | 4/1984 | Mehl | 49/462 |
| 4,582,739 | A | * | 4/1986 | Givens | 248/345.1 |
| 4,801,018 | A | * | 1/1989 | Wilde | 206/586 |
| 5,604,011 | A | * | 2/1997 | Morley | 206/453 |
| 5,799,429 | A | * | 9/1998 | Speshyock | 40/778 |
| 5,871,194 | A | * | 2/1999 | Morley | 248/345.1 |

* cited by examiner

*Primary Examiner*—Bryon P. Gehman
(74) *Attorney, Agent, or Firm*—Renner, Otto, Boisse & Sklar, LLP

(57) ABSTRACT

A corner protector has a pair of opposite frame embracing faces which are resilient and bowed so that, in use, the corner region of a frame to be protected must force its way into position on between the opposite faces of the protector and will thereafter be frictionally gripped between them until the protector is subsequently released by pulling it off against the frictional resistance. Frame-gripping ribs may be incorporated on the major faces of the protector and in addition the protector may be tapered outwardly from its apex to its open mouth to provide a lead for insertion of the frame. To provide a still greater lead, the open edges of the protector may each be given a slight flange extension, but at opposite ends of the two edges.

9 Claims, 9 Drawing Sheets

FIG. 17
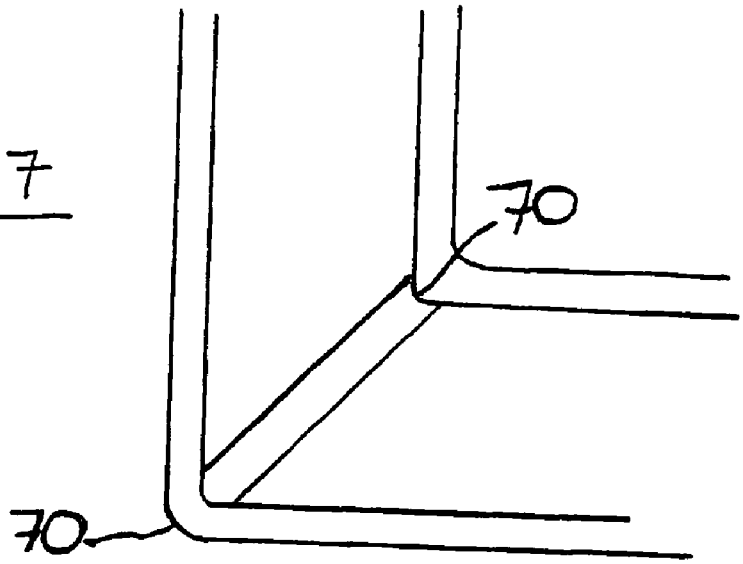
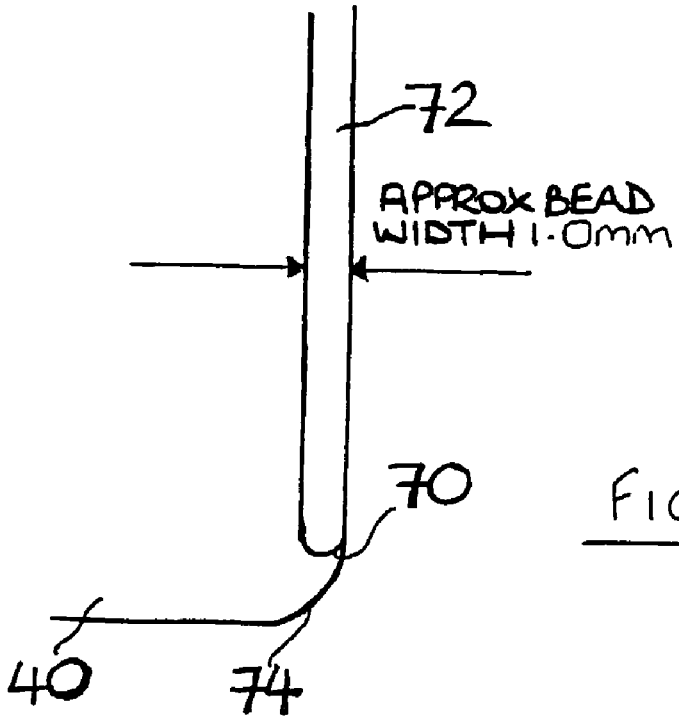
FIG. 18

BOWED CORNER PROTECTORS FOR PICTURE FRAMES

This application is a national phase of International Application No. PCT/GB03/00881 filed Mar. 3, 2003 and published in the English language.

FIELD OF THE INVENTION

The invention relates to corner protectors.

In this patent specification, a corner protector is a fitment so sized and shaped as to embrace a corner region of a picture frame, poster card sheet, mounted art print, shrink-wrapped art print, mirror, sheet material or the like, between opposite surfaces in a releasable manner so as to afford temporary protection to the corner edges whilst the picture frame etc is in storage or in transit and in retail display.

THE STATE OF THE ART AS KNOWN TO THE APPLICANT

Corner protectors are in widespread use and are conventionally made of stiff laminated and/or corrugated card, folded up into a generally triangular shape, and defining in end elevation a rectangular opening into which the corner region of the picture frame is inserted.

Usually the triangular face of such a conventional card-folded protector is then stapled or taped to the back of the wooden frame of the picture so as to stop it coming adrift before the user is subsequently ready to remove it.

These known forms of corner protector work well up to a point but they have drawbacks. Chief amongst these drawbacks is the need of course to remove the staples from the back of the frame in order to get the corner protector off the picture frame edge when the picture is to be hung and displayed. Usually the staple gun will have forced the metal staple far enough into the wooden picture frame for it to be a nail-breaking task to remove the staples.

It is therefore relatively common for picture handlers, when the picture is to be hung and displayed, simply to rip the relatively fragile card protector off the corner region of the frame and leave the staples in place. The reasoning is of course that the staples, being fixed to the back of the frame, won't be seen during any display of the picture since the back of the frame abuts the wall or other surface on which the picture hangs.

This is an admirably practical view but nevertheless it cannot be denied that the presence of the staples, and inevitably at least some area of card still surrounding them on the picture frame back, is unsightly.

It has also been known to hamper the insertion and stapling of future corner protectors to the same picture frame, because these protectors are of course one-shot-use items whose cost of manufacture is trivial compared with the value of the job they are designed to do and the frames whose corner edges they are designed to protect. The same picture will therefore have up to four corner protectors stapled to it at any one time when it is not being displayed and, after two or three storages and/or transits in between successive displays, its back frame can begin to look extremely unsightly with remaindered staples sunk into it.

There is also a foreseeable risk of the next set of staples not taking proper hold, or even springing back out of the frame, should they happen to hit one of the old previous remaining staples as they are driven in. This could conceivably extend as far as damaging or distorting the frame itself.

There is a need therefore for some new form of corner protector which at least reduces the drawbacks of these conventional card-based ones with their stapled attachments.

SUMMARY OF THE INVENTION

In its broadest aspect the invention is embodied in a corner protector, whose opposite frame-embracing faces are resilient and bowed so that, in use, the corner region of the picture frame must force its way into position between the opposite faces of the protector and will thereafter be frictionally gripped between them until the protector is subsequently released by pulling it off against the frictional resistance.

Such a protector needs no stapling into place (although there is no theoretical reason why it should not also receive that treatment) and so, if desired, can be re-used rather than being a one-shot-use item. This lack of damage to the protector itself means that it can be produced in more expensive materials than the traditional laminated or corrugated staple-fixed protectors reviewed above. It could for instance be extruded or moulded from plastics material whilst still being economically feasible and it could, in such instances, form an altogether tougher and more effective protector than the all too easily frayed, split, and otherwise damaged card ones.

Making the protector out of a plastics material has other advantages. It makes it possible for the protector to be translucent and indeed to be wholly or partially transparent without any extra manufacturing cost and with no adverse effect at all on its inherent strength and protective capabilities. It can also be self-coloured with attractive results.

It is particularly advantageous if one at least of the frame-gripping opposite surfaces of the protector is wholly or partially transparent, because then the protector can be used in combination with a simple card or paper sleeve, for simply carrying a logo or identifying or advertising material on one or more of its faces and fitting, in use, inside the protector so that the transparent portion of the protector enables the identifying and/or advertising message on the sleeve to be viewed. Alternatively, it is envisaged that such information may be embossed into the protector wall itself, in which case it is not necessary for the protector to be transparent.

Because the protector relies essentially on its inherent ability to grip the corner region of the frame between its opposite surfaces, anything which will increase the gripping capability without making it unduly onerous to squeeze the frame into the protector initially, will be an advantageous and inventive add-on to the broad inventive concept.

Preferably therefore one at least of the frame-gripping opposite surfaces of the protector is ribbed, dimpled, inherently corrugated and/or just roughened so as to enhance its frictional grip in use. Whilst such surface treatments are known in themselves, none of them is possible with the conventional card material hitherto used for protectors. No such treatment would therefore be contemplated by the skilled but nevertheless conventional thinker in this field. To add any—or any combination—of them to a protector embodying the broad concept of the present invention is therefore inventive if—as is believed to be the case—such an additive combination is a new one.

The invention includes within its scope the combination of a protector of the kind just defined (i.e. with one at least of its frame-gripping surfaces treated to enhance its gripping effectiveness in use) with a frame whose own surface, at its corner region or regions, is grooved, indented, or otherwise so treated that as the protector is pushed onto the frame corner region in use, the ribs, dimples, or the like of the protector surface will slide and/or snap into the grooves, indentations etc of the frame surface. It also extends to such a frame itself Clearly no frame forming part of the combination just defined is likely to have such a treatment on its outer surface (i.e. that surface which, when the picture is hung or displayed, is visible) although it is not theoretically impossible. What is more likely to happen is that the back surface of the frame will be so treated. In another advantageous development of the invention, however, the grooves and/or dimples etc are formed in the edge surface of the frame instead of—or as well as—being formed into the back surface.

This latter development has the advantage that it is not necessary, if only the edge surface of the frame is so treated, for the user to first work out which surface of the protector is internally treated and then push the protector onto the frame corner appropriately. Instead he can simply push the protector into place quickly without having to differentiate between its opposite frame-gripping surface internal treatments.

Although the invention has been discussed so far in relation to its use generally on picture frames and mirrors, protectors embodying the inventive concept may also be used on poster card sheets and sheet materials generally. Poster card sheets are notoriously fragile and all too often creased and bent or frayed, especially at their corner regions, by the time the purchaser gets them home from the gallery or shop purchase point. Conventional card stapled corner protectors simply cannot be used with poster card sheets. Protectors embodying the invention by contrast can with appropriate care be pushed into and subsequently removed from position with no real danger of damage to the poster sheet.

The invention includes within its scope a corner protector; or a frame-and-protector combination; or a frame, substantially as described herein with reference to and as illustrated in any appropriate combination of the text and drawings comprising this patent specification.

The invention also envisages the provision of a taper of nominally, e.g., 0.5° each side from the protector apex to the open ends of the minor surfaces of the protector, along with the bowing of the major walls towards each other at their open ends described in connection with, for example, FIGS. 1 and 2. The taper provides a lead for the easier insertion of a frame into the protector at the extremes of the bowed edges. A further refinement is the provision of a short extension piece at the end of each minor surface, which is angled away from the plane of the minor surface to lie approximately along the plane of the open ends of the major surfaces. These extension pieces may conveniently act as ejection points for the removal of the protector from its mould. Since the extensions lie outside the protector's areas of contact with the frame, no sharp points or flash can interfere with the frame when it is inserted.

The apex of the protector may be given a slight outward bulge, so as to create a space between the inside of the protector apex and the apex of the frame-corner being inserted and the bulge may be part of a circle of a given radius. This removes the considerable insertion forces of the entering frame from the apex line and redistributes them over a wider area due to the curvature.

A further degree of lead for the ready insertion of a frame corner into the protector may be provided by arranging for the two open edges of the protector to have a slight flange-like protrusion, but at opposite ends of the protector. Thus each flange may act as a kind of stop against which the frame corner may abut, the frame being subsequently readily inserted into the protector itself. It is advantageous if each flange occupies approximately one-half the length of its associated open edge.

When such flanges are employed, it is expedient to fashion ejection points as small recesses at the end-portions of the minor surfaces of the protector, the recesses having flat surfaces against which the mould ejection forces will be applied. In order to reduce the risk of damage to these flat surfaces, these end-portions are provided with a thicker wall adjacent the flat surfaces, e.g. in the form of a curvature of a given radius.

In a further aspect of the present invention there is provided a frame fitted with four protectors in any of the configurations described above, wherein each protector further comprises a hole associated with at least one if its major or minor surfaces and the protectors are connected by a filament passed through the holes and forming a loop, the loop allowing the frame to be hung on a vertical surface while at the same time holding the protectors firmly against the corners of the frame.

BRIEF DESCRIPTION OF THE DRAWINGS

Practical embodiments of the invention will now be described with reference to the accompanying drawings in which:

FIG. 2 shows the same corner protector viewed en-on;

FIG. 12*a* illustrates a further embodiment of the protector according to the invention and FIG. 12*b* a view along the direction 'XIIB', while

FIGS. 17 and 18 show protectors in accordance with a further embodiment of the invention, in which external radii are provided;

DESCRIPTION OF THE ILLUSTRATED EMBODIMENTS

Figure 1:
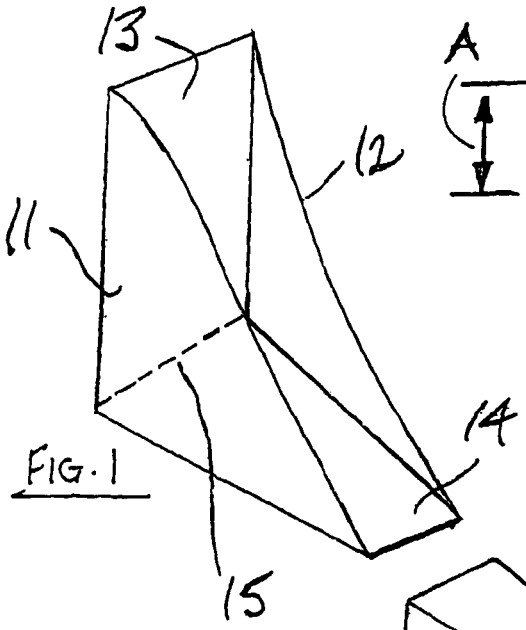
FIG. 1 shows one corner protector, embodying the invention, in perspective.

The corner protector of FIG. 1 is intended to protect one of the four corner regions of a wooden picture frame when the frame is in storage, transit or retail display. It is made from resilient plastics material such as polypropylene and it is both translucent and transparent throughout allowing bar code scanning of the price ticket inserted between the corner and the frame. Its two triangular walls 11, 12 together with its rectangular bases 13 and 14 are formed integrally as one continuous moulding and the walls 11, 12 and the bases 13, 14 of a similar thickness as one another and each the same uniform thickness throughout their respective extents.

Figure 2:
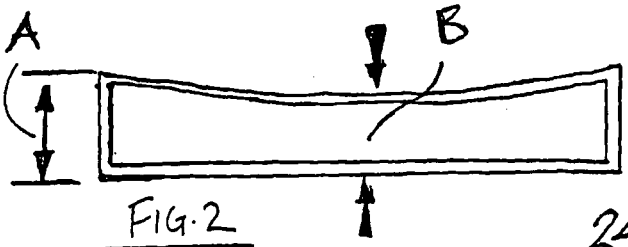

As FIG. 1 attempts to show, wall 12 is noticeably bowed towards wall 11. FIG. 2 shows this more clearly. The gap A between the two triangular walls 11 and 12 is appreciably (although not excessively) greater than the gap B. Gap A is the distance between walls 11 and 12 where they join integrally bases 13 and 14. Gap B is the distance between the same two walls at the mid-region of the opening defined between them.

Figure 6:
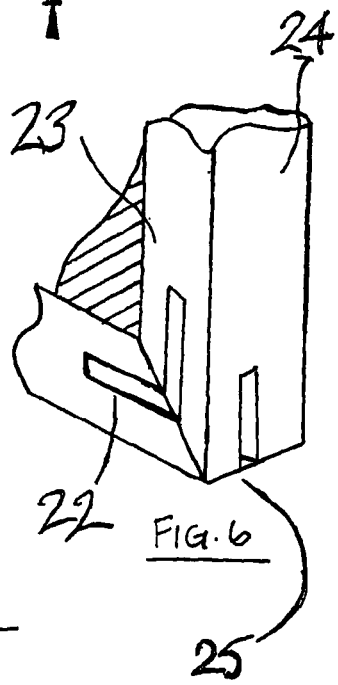
FIG. 6 is a perspective view of one edge region of a wooden picture frame modified to work in combination with either of the protectors of FIGS. 4 and 5.

In use, the corner region of (for example) a wooden picture frame such as that shown in FIG. 6 is pushed into position by forcing its way between the resilient opposite faces 11, 12 of the corner protector until its own corner edge abuts the right-angled join between the protector bases 13 and 14 inside the protector body. The corner protector is of course so shaped and sized that it would be a snug frictional fit around the wooden frame edge if the gap A defined between its walls 11 and 12 were constant. In reality because of the bowing as illustrated by gap B the protector grips the frame—thanks to the inherent resilience of its plastics walls—more tightly than would be the case if gap A were indeed the same as gap B across the width of the protector.

Frictionally gripping the corner region of the frame in this way, the resilient plastics protector does its job, because its walls are thick enough to withstand knocks and scuffing externally whilst being inherently resilient enough to be re-used several times. When the corner protector is released from the frame it is protecting by pulling it off against the frictional resistance exerted by its walls 11 and 12 on the frame surfaces, the inherent resilience of the material from which it is made is sufficient for it to resume its FIG. 2 state. In normally intended re-usage of these relatively cheaply produced articles, that resilience will not be unduly affected by cumulative stress fatigue.

Figure 3:
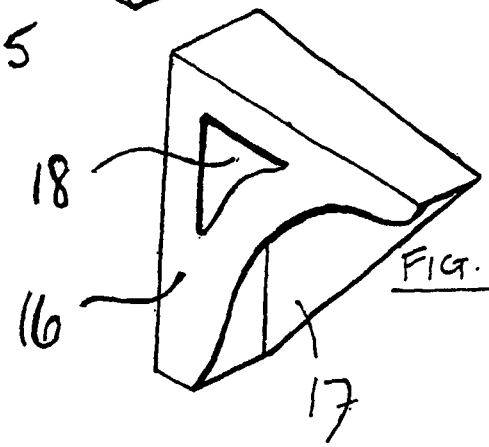
FIG. 3, again in perspective, shows another corner protector embodying the invention.

The corner protector of FIG. 3 works in the same way as that of FIG. 1 but there are differences between the two. In the FIG. 3 embodiment, one of the frame-gripping walls 16 of the protector is not geometrically identical to the opposite wall 17. The latter wall 17 is, like the walls 11 and 12 of FIG. 1, essentially triangular in shape. Wall 16 by contrast is cut away to illustrate that the invention is not restricted to simple geometrically-overlaid wall shapes such as the walls 11 and 12 of FIG. 1.

Another difference is that a portion 18 of wall 16 of the FIG. 3 protector is transparent. Indeed in this particular case it is a cut-out formed in the material of wall 16. It could be filled in with transparent material or it could contain oppositely-coloured material; or both.

Figure 4:
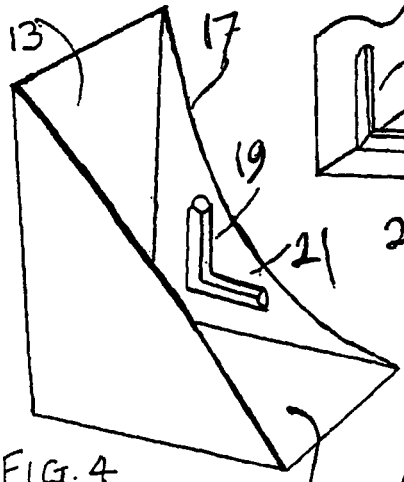
FIG. 4 shows yet another one, again in perspective.

In FIG. 4 one of the frame-gripping walls 17 of the protector shown is, like those of the previous embodiments, bowed towards its opposite wall; but ribs 19, 21 running parallel to the respective right-angle-joined bases 13 and 14 are formed on-the inside (i.e. on the frame-gripping) surface of wall 17.

These ribs 19, 21 project internally from wall 17 so that, when the protector is pushed into place over a picture frame, they will simultaneously enhance its gripping action and resist any inadvertent dislodging of it once it has been pushed fully home. They could be so positioned—and the protector overall so proportioned—that, when they are fully home, they snap into place just inside the inner edges of the frame (i.e. the edges adjacent the periphery of the picture itself when viewed in its frame).

Alternatively, or additionally, ribs such as the ribs 19, 21 could engage in grooves 22, 23 formed in the frame surface as shown in FIG. 6. The frame 24 is wooden as previously indicated. The ribs 19 and 21 of the FIG. 4 corner protector snap into the grooves 22 and 23 of the wooden frame back surface when the protector is fully home.

Figure 5:
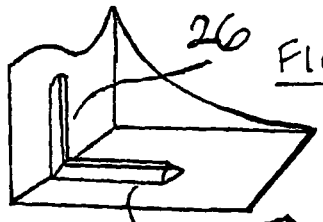
FIG. 5 is a simplified view of a further corner protector embodying the invention, drawn in perspective but with its front surface removed for clarity.

As FIG. 6 also shows, edge grooves 25 can be formed in the picture frame as well as (or instead of) the grooves 22 and 23. In such an instance the protector could be correspondingly ribbed as shown at 26 and 27 in FIG. 5 (in which one of the frame-embracing walls of the protector has been removed for clarity and only a portion of the remainder of the protector body is shown).

Figure 7:
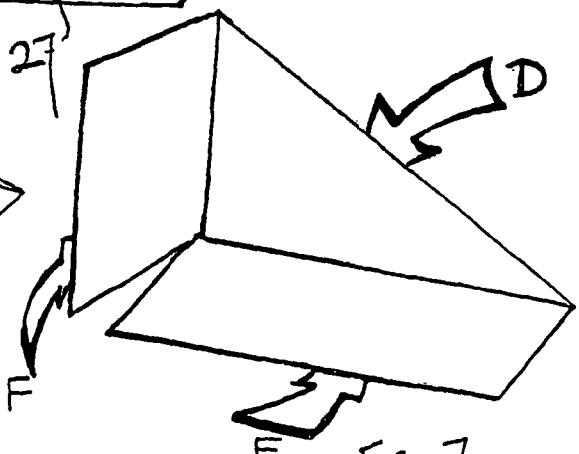
FIG. 7 shows a card or paper sleeve for use with any of the protectors of FIGS. 1 through 5.

In FIG. 7 a simple fold-up card or paper sleeve is illustrated which, in use, fits inside any of the translucent protectors shown in FIGS. 1 through 5. The sleeve can have identifying and/or advertising material displayed on its major face D and/or on either of its other faces E and F. It would of course fit into (for example) the protector of FIG. 4 so that its face D underlay the non-bowed wall which faces the ribbed wall 17 of that FIG. 4 embodiment. Any attempt to fit it the other way round would result in its being distorted as soon as (in this particular embodiment) ribs 19 and 21 began to bite against the picture frame surface as the protector was pushed fully home.

Although all the protectors illustrated so far have one, only, bowed wall 12 preferably both walls should be bowed towards and away from the other. There are practical commercial reasons why this is desirable as well as the increased frictional gripping capacity obtained thereby in use.

Figure 8:
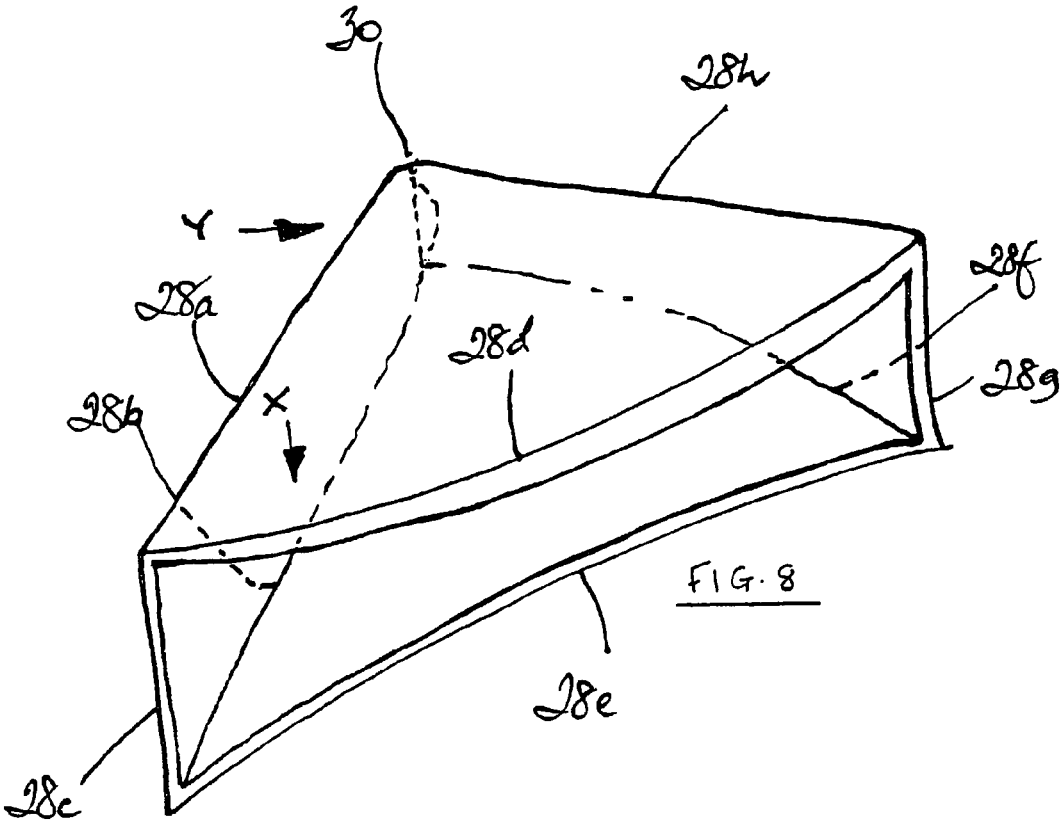
FIGS. 8 to 11 show a preferred embodiment incorporating edge ribbing.
Figure 9:
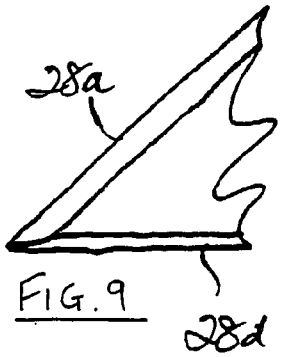
Figure 10:
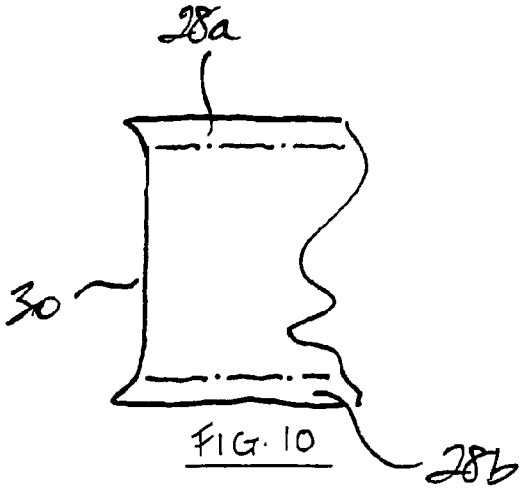

In FIG. 8, the protector surfaces bow concavely towards each other and are reinforced with external ribs or lips 28*c*, 28*d*, 28*e*, 28*g*. The remaining outside edge surfaces of the protector—other than the apex edge 30—are also thus lipped or ribbed as indicated by 28*a*, 28*b*, 28*f*, 28*h*. FIGS. 9 and 10 illustrate this in more detail. FIG. 9 is a view from the side of the protector (i.e. looking in the direction of arrow Y in FIG. 8). FIG. 10 is a view from above (arrow X in FIG. 8). Both views are part-views only but illustrate the ribbing which is continuous along the respective edges.

One of the important design features is the ability of the corner protectors to redistribute impact forces from the vulnerable corner regions of the frame in use: this occurs via the "ribs" just mentioned, which in preferred embodiments surround the mouth periphery of the protector and (preferably) optionally its edges. These extra-thick ribs or flanges absorb and dissipate the forces. As mentioned, they are thickened regions which extend along the edge lines externally and/or internally of the protector.

Figure 11:
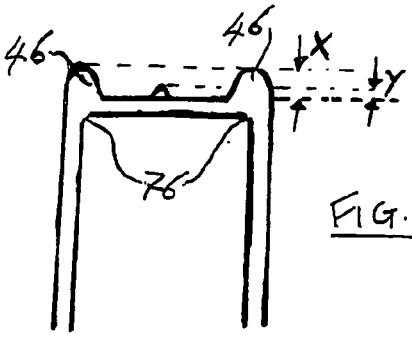

The gate point of the protector is advantageously positioned at the apex of the protector, but since in practice a protrusion may be formed during the moulding process at the gate point, the current invention arranges for the external ribs to have a profile which is higher than the likely profile of the gate-point protrusion itself (see FIG. 11). In the diagram this is shown as the condition that distance "X" should be greater than distance "Y".

The protrusion just mentioned may take the form of a small "blip" which has minimal visual product effects, and will be almost invisible, but is added to the design for fast efficient cycle times in a production environment. Such a blip could be located at the apex of the triangular mould, as shown in FIG. 11, or on a face and/or edge (see, eg. blips 80 on the major faces of the protector shown in FIG. 16*a*).

Figure 12A:
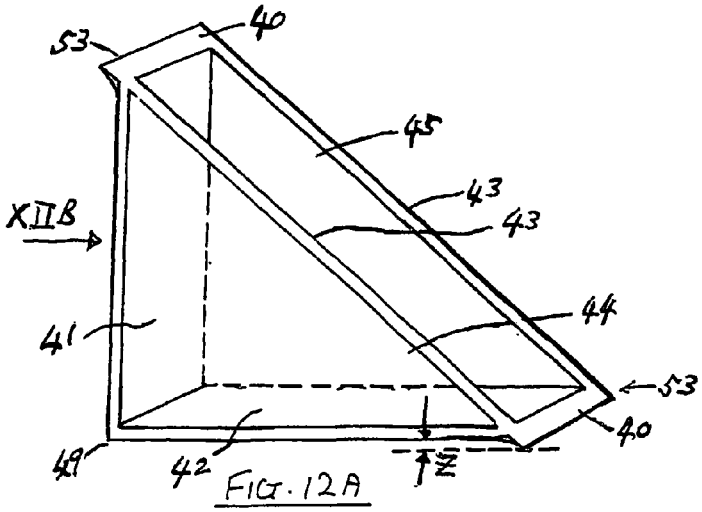
Figure 12B:
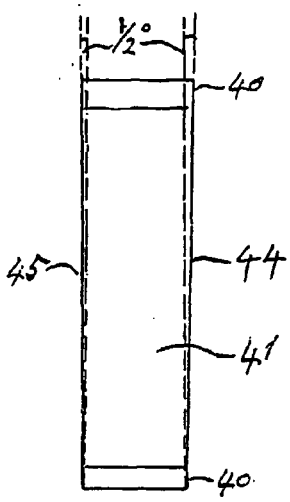
Figure 12C:
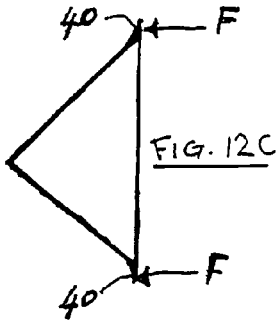
FIG. 12*c* is a side view of the protector showing the application of an ejection force to the protector at the end of the moulding process.

A further variant of the protector according to the invention is shown in FIGS. 12*a* and 12*b*, in which small extension pieces 40 are provided at the ends of the minor surfaces 41 and 42 of the protector. The extension pieces 40 are angled from the plane of the minor surfaces so as to lie approximately along the plane of the open ends 43 of the major surfaces 44, 45. The extensions act as strong ejection points against which an ejection force "F" (see FIG. 12*c*) is applied when it is desired to remove the protector from its male counterpart at the end of the moulding process. In addition, the minor walls 41, 42 are tapered outwards from the apex 49 to the ends 53. It is preferred if the degree of tapering is of the order of 0.5° each side. The slightly wider open ends of the protector due to the tapering provides a "lead" which facilitates the insertion of the frame into the protector.

It is preferable if a degree of bowing, as shown in FIGS. 1 and 2, be employed along with the taper in order to ensure an adequate gripping effect on a frame or sheet member, while at the same time preserving the advantageous lead provided by the taper.

It is worth noting that the extension pieces 40 shown in FIGS. 12*a* and 12*b* are arranged to have a maximum height (height "Z" in FIG. 12*a*) in order to allow the protector to sit as near level as possible when resting on a surface.

Figure 13A:
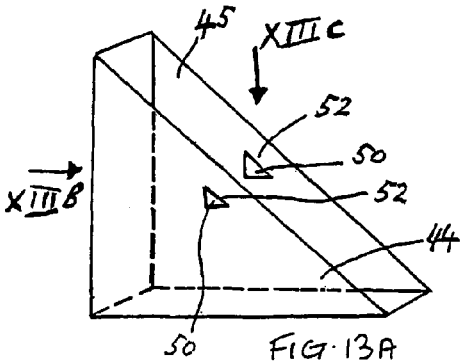
FIG. 13*a* is a perspective view of a further variant of the protector according to the invention with FIGS. 13*b* and 13*c* being views along the directions 'XIIB' and XIIIC', respectively.
Figure 13B:
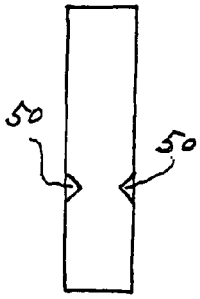
Figure 13C:
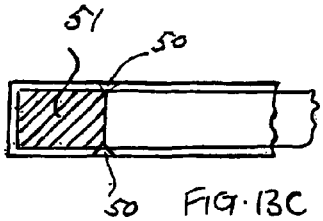

It has already been described (see FIGS. 4, 5 and 6) how the major surfaces of the protector may be provided with internal ribs or the like for mating with corresponding grooves in the frame to be protected, these members forming a temporary locking mechanism for the frame in the protector. FIGS. 13*a*, 13*b* and 13*c* show an alternative form of "locking" mechanism in which the major surfaces 44, 45 have partially cut-out tabs 50 which, after the frame has been inserted into the protector, are pushed inwards so as to lever towards the frame along the bending line 52, thereby forming a restraint against the removal of the frame 51. This form of locking mechanism is more permanent than the earlier described mechanism and is normally only deployed if it is unlikely that the protectors will be removed. However, if required, it is still possible to forceably remove the protector from the frame, albeit with a high risk that the tabs will be broken off in the process. If that does occur, it is still possible to reuse the protector, but without the possibility of re-locking it against the frame in the manner just described.

Figure 14:
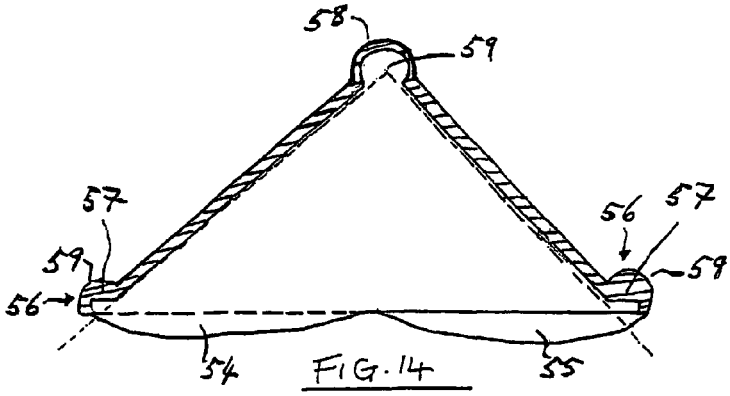
FIG. 14 is a side view of a further embodiment of a protector according to the invention.

A form of protector in accordance with the invention which is particularly applicable to the protection of thin laminates, e.g. float glass, mirrors and prints, is shown in FIG. 14. In FIG. 14 the protector in its preferred form is equipped with three special features in addition to the bowed open-end feature shown in, for example, FIGS. 1 and 2. These are: the flanges 54, 55 (one on each open edge of the protector, but at opposite ends, as shown); recessed lips 56 having flat inside surfaces 57; and a radiused apex 58. The staggered flanges function as a lead for the print, etc, when it is desired to insert the same into the protector.

Since there is one flange at each end of the protector, the print may be introduced at either end, which facilitates insertion. The lips 56 have in addition to the flat surfaces 57 a thick, radiused portion 59, which increases the strength of the protector at these points and ensures that the ejection force when applied to the surfaces 57 will not pierce or otherwise damage the protector. Finally, the curved apex 58 functions firstly to provide a space between the apex of the frame corner when inserted and the protector apex and, secondly and resulting from this, to distribute the insertion forces of the incoming frame over a wider area than just the conventional linear apex itself.

Figure 15:
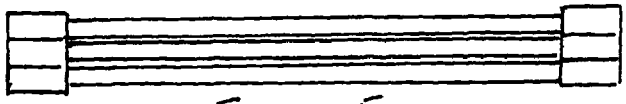
FIG. 15 shows the stacking of plate glass equipped with the protectors of FIG. 14.

In addition, due to the inherent strength of the moulding material used, the protector of FIG. 14 can be made with walls as little as 0.5 mm thick, which means that, if used with fragile inserts such as float glass and with such glass sheets stacked one upon the other (see FIG. 15), each with the illustrated protectors fitted, any force applied to one sheet of glass against the next is unlikely to damage the glass. The same applies if, for some reason, one of the protectors is missing, leaving a gap in the stack at that corner. Due to the thinness of the protector wall, the gap left will not allow a bending of the glass at that point sufficient to cause significant damage to it.

Several advantageous enhancements, which may be incorporated into any of the embodiments of the protector so far described, are now outlined.

Figure 16A:
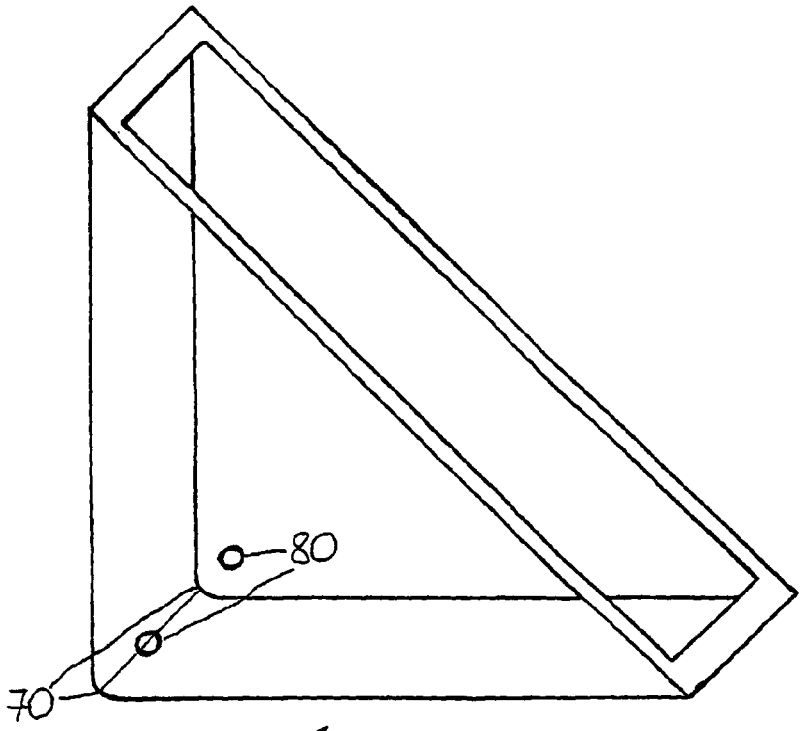
FIGS. 16*a*, 16*b* and 16*c* are views of a protector in accordance with an embodiment of the invention in which external radii are provided.
Figure 16B:
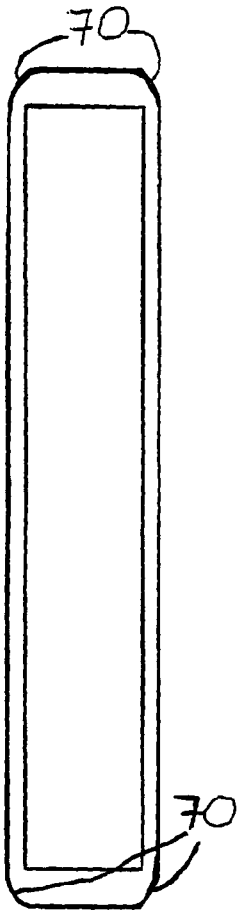
Figure 16C:
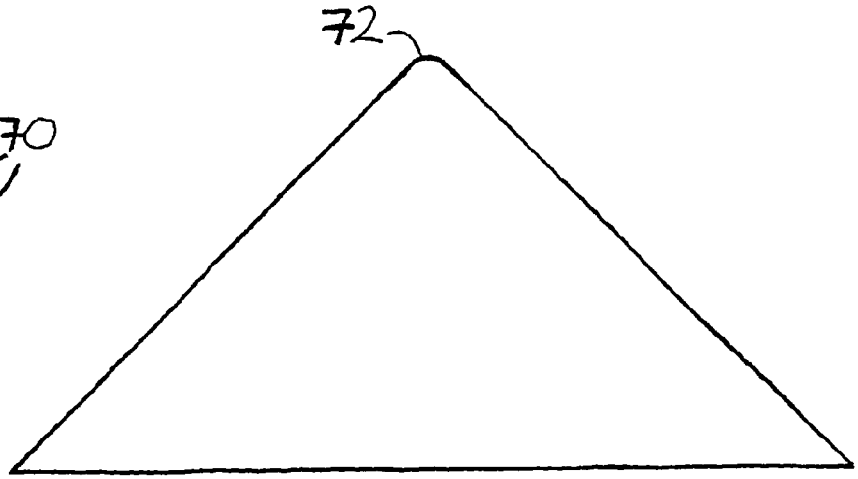

FIGS. 16*a* and 16*b* show a basic protector having at each corner an external radius 70 of a suitable maximum value which ensures that no damage can occur to surrounding items or to any shrink-wrap that is employed around the corners of the protector or on the frame. (FIG. 16*a*, incidentally, also shows a pair of blips 80 on the internal major faces near the apex. As mentioned earlier, these blips aid the manufacturing process by allowing easier ejection of the protector). A similar radius 72 is applied also to the apex of the protector (see FIG. 16*c*).

FIGS. 17 and 18 illustrate the use of such a radius 70 on a protector featuring external beading ("ribs"), as shown initially in FIG. 11. In FIG. 18 not only the ribs 72 are radiused by smoothing their end-profiles, but the ejection areas 40 (cf. FIGS. 12*a* and 12*b*) are also blended into an external radius 74.

Figures 19A, 19B:
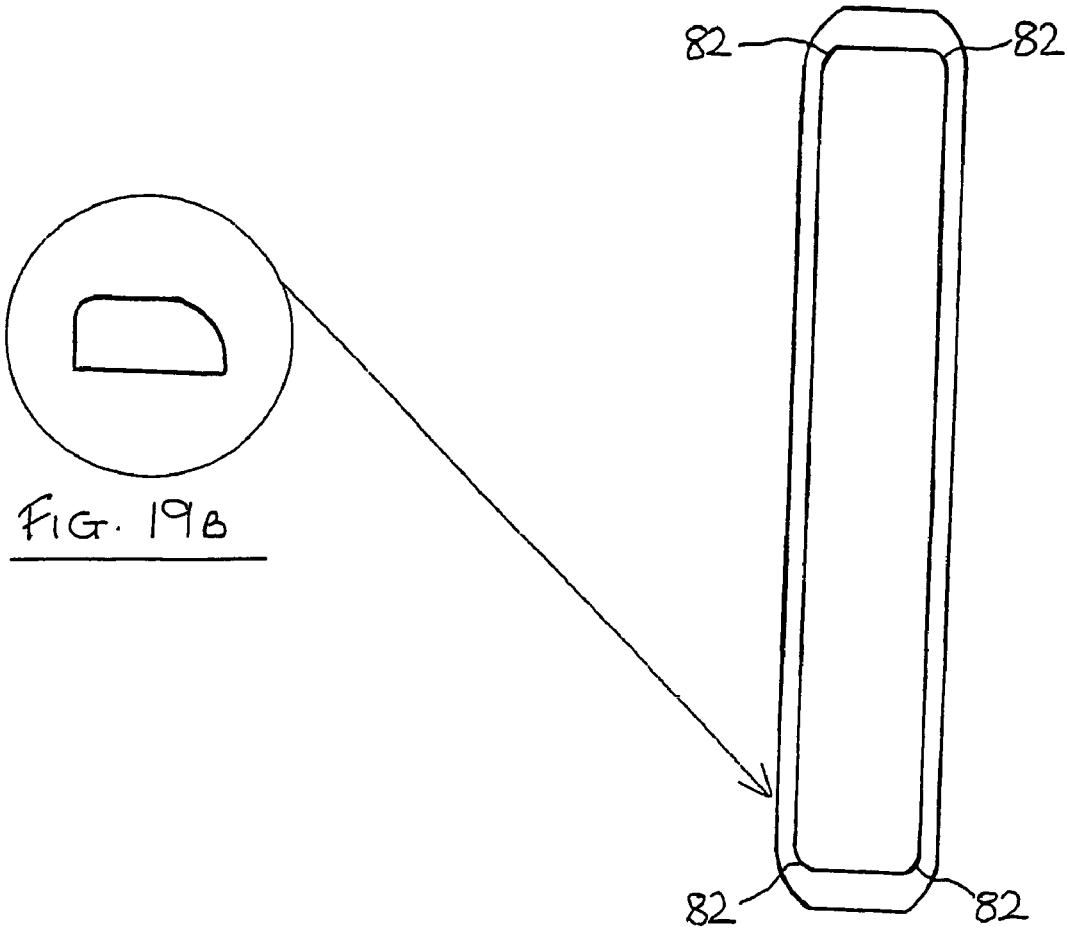
FIGS. 19*a* and 19*b* illustrate the use of internal radii in an embodiment of the protector according to the invention.

Radii may not only be applied to external parts of the protector, they may also be applied to internal areas. One example of this is shown in FIG. 11, in which an internal radius 76 has been introduced at the apex of the protector in order to eliminate the otherwise existing sharp edge, which would constitute a weak point when the protector was under load. Internal radii may be provided at other locations as well to ensure that no damage is caused to the frame, etc, when the protector is applied to the frame and also when under load during transportation. An example of this is shown in FIG. 19*a*, in which internal radii 82 are applied to the open mouth of the protector. A way of profiling the protector wall is illustrated in FIG. 19*b*.

Figure 20A:
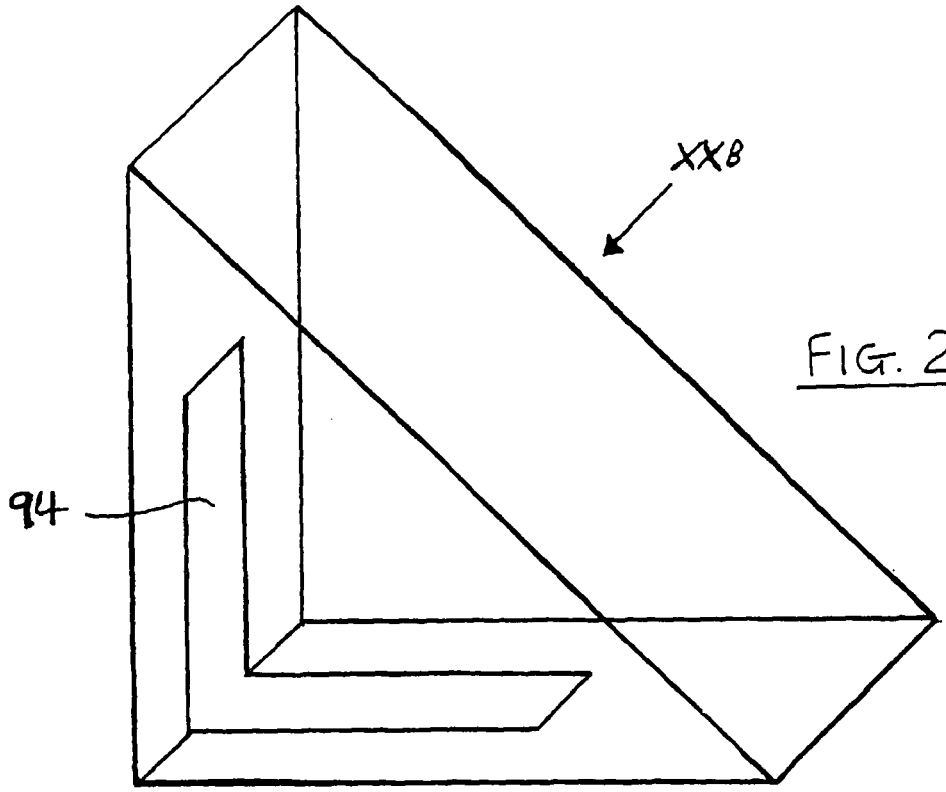
FIG. 20*a* is a perspective view of an embodiment of the protector in accordance with the invention comprising a slot at an apex region of the protector.
Figure 20B:
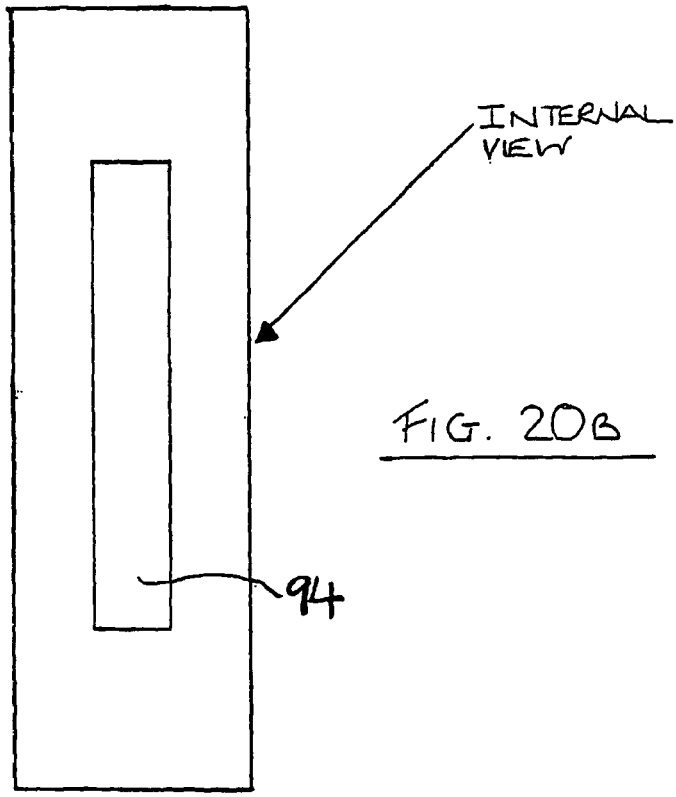
FIG. 20*b* is a view of the same protector in the direction XXb.

A further enhancement, which may or may not be advantageous, depending on the use to which the protector is put, is shown in FIGS. 20*a* and 20*b* and consists of the provision of a slot 94 in the minor walls in order to give some flexibility to the protector around its apex. The slot 94 extends partway up each wall and is continuous from its starting point, say halfway along one wall, round past the apex to its finishing point, say halfway up the other wall. The length of the slot relative to the length of the wall and the width of the slot determines the degree of flexibility which it confers. One reason such flexibility might be an advantage is if the frame or sheet member to which the protector is to be applied is slightly wider at its corner (frame apex) than further along its walls. In such a situation it might conventionally be necessary to employ a generally slightly wider version of the protector, but there would then be the risk that, even with the bowing described in connection with FIGS. 1 and 2, for example, there would not be sufficient grip between the protector and the frame/sheet member. When a slot such as is shown in FIGS. 20*a* and 20*b* is employed, the grip will not be prejudiced and the frame, etc, will still be insertable into the protector, though with some resistance until the wide apex of the frame has entered the apex region of the protector, at which point the protector apex gives slightly and the protector is securely seated on the frame. There will then be two measures enhancing the protector's grip on the frame: the initial bowing of the open ends of the protector and the additional use of the slot 94.

Figure 21:
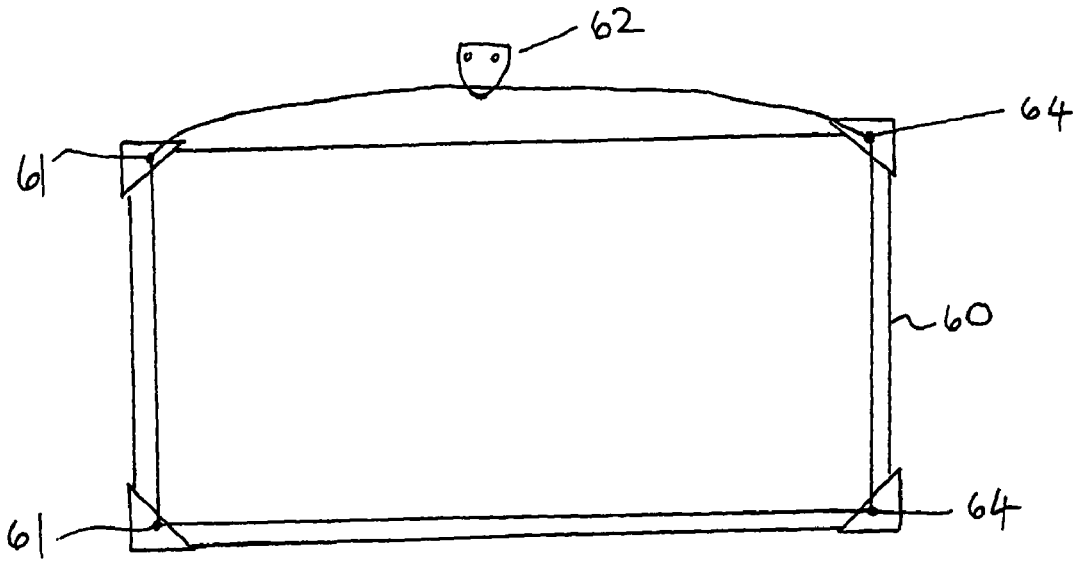
FIG. 21 is a rear view of a mirror or similar item equipped with protectors in accordance with the invention and a connecting filament for hanging purposes.

In FIG. 21 there is illustrated an arrangement in which a mirror 60 with wooden or other backing is equipped at each of its corners with any of the protectors hereinbefore described and in which the protectors are supplied with a small hole 61 in a suitable location, e.g. at a point on their backward facing major surface (FIG. 21 is a rear view). If now a strong filament such as a thin twine or similar (fishing line is envisaged as being particularly suitable in this application) is passed through the four holes and completed as a closed loop, the mirror may be hung upon a wall or other vertical surface at a point 62, whereupon the action of hanging the mirror will also cause a tightening of the four protectors against the corners of the mirror, thereby securing it effectively against being dislodged and damaged.

In a variant of the illustrated arrangement, more than one hole is provided in each protector, e.g. in the same major or indeed minor surface thereof, and the twin passed through the protector from the rear through one hole and back out through the other.

Figure 22:
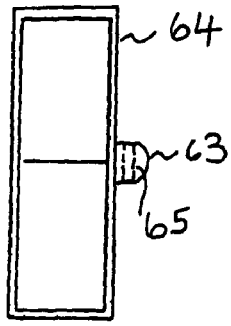
FIG. 22 is a view into the open mouth of a protector according to the invention and featuring also a connecting piece for use as a picture hanging aid.

An alternative form of securing point for the twine is shown in FIG. 22 and is constituted by a protrusion either moulded as an integral part of the major surface 64 or secured by some other means thereto (e.g. by adhesion or welding). A hole 65 is formed in the protrusion and the twine passed through that. In this arrangement there would normally be no need to provide multiple holes in the same protector.

It should be noted that many of the features heretofore described may be incorporated in a variety of combinations. For example, the flanges of FIG. 14, which provide a lead for frame insertion, may be employed with or without a taper on the minor walls of the same protector. Where a taper is additionally provided, there will simply be a greater degree of lead and insertion will thereby be even further facilitated. It is also possible to employ the recessed ejection surfaces shown in FIG. 14 in the standard form of the protector shown in, e.g., FIG. 1.

Because the clear corners of the protector protect the retail price ticketing and description, it is possible to produce high definition printed price ticketing, on cheap paper, using a cheap printing paper. This is preferable to the present situation, in which expensive abrasion-resistant labels have to be printed.

Also, many retailers fear that their customers will remove such labels and place them on more expensive frames. This system makes it very difficult for this to happen.

Because of quality on-edge retail ticketing, frames can be displayed on edge like books on a bookshelf. However the "ribs" of the corners would catch against each other, so the ribs are given a specific radius to prevent this.

In the design of the corner protector moulding tool, the mould walls are reverse tapered and the bead around the periphery of the protector mouth is reduced and tapered to reduce "catching" as corners of frames are dragged alongside one another. This also aid ejection at the end of the moulding process and increases flow, reducing cycle times and cost of manufacture.

Figure 23A:
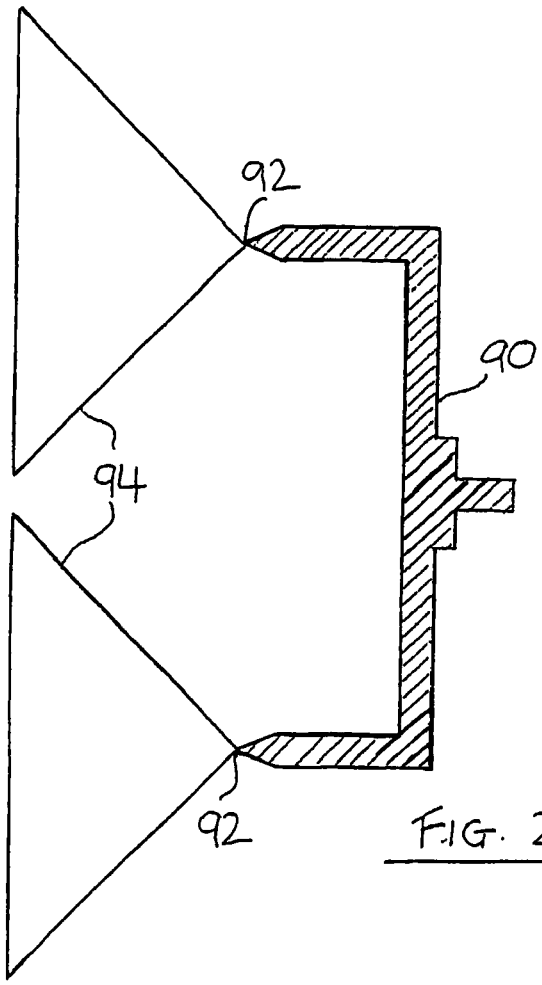
FIGS. 23*a* and 23*b* are side and plan views, respectively, of part of an apparatus employed to manufacture the protector in accordance with the invention.
Figure 23B:
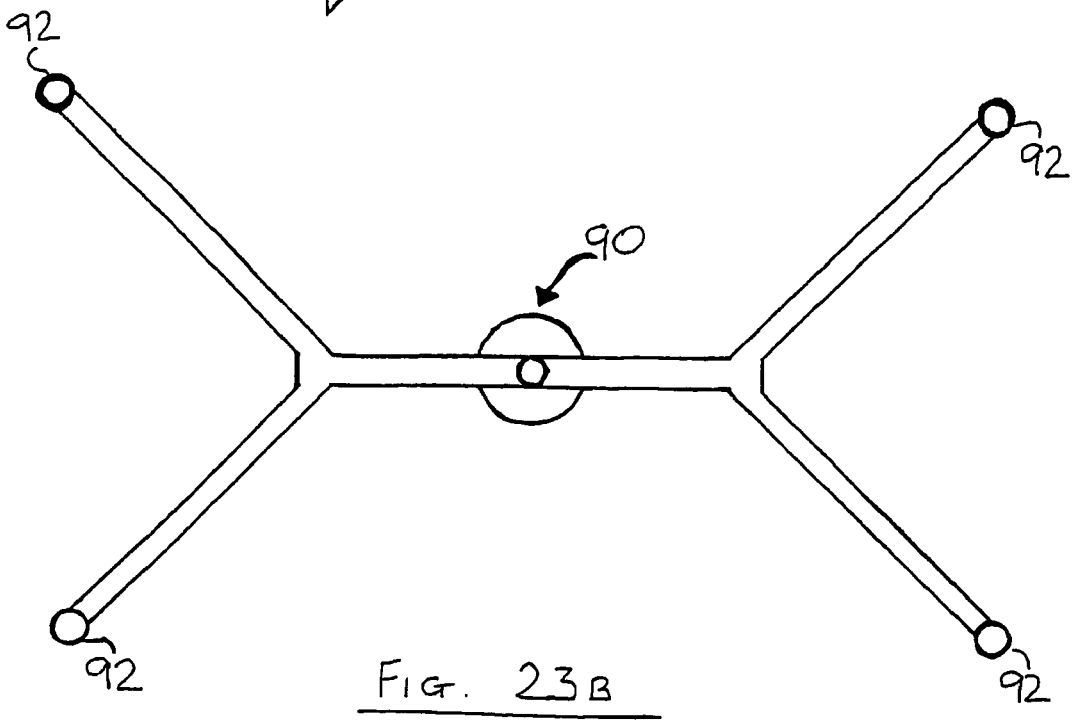

As regards the moulding process, the present invention provides for minimisation of material waste. The moulds themselves are produced by standard 3-plate tooling and this creates a waste part (a so-called "runner") every production cycle, which may be, e.g., every four units. The runner is shown as item 90 in FIGS. 23*a* and 23*b* and the gate points are also shown as items 92, with the units themselves as items 94. During the manufacturing process of the protector according to the present invention the runner is reground and fed back into the system via a closed-loop process.

In addition all cores and cavities are insertable, which allows one standard set of bolster plate work to carry all sizes of protector. The tooling is also designed to give the maximum amount of variable cooling. This enables a "Hugging" effect across the open faces to be achieved and controlled.

The invention claimed is:

1. A corner protector having opposite front and rear faces configured so as to embrace between them, in use, a corner edge region comprising the opposed front and rear external surfaces of a picture frame, and side edge portions disposed at an angle and extending between the front and rear faces for primarily covering the corner edge region of the frame, at least one of said opposite faces being triangular in plan view and resilient and smoothly bowed towards the other face so, in use, the corner region of the picture frame must force its way into position between said opposite faces of the protector and thereafter be frictionally gripped between them until the protector is subsequently released by pulling it off against the frictional resistance.

2. A corner protector according to claim 1, wherein at least one of the front and rear faces of the protector is at least partially transparent.

3. A corner protector according to claim 2 used in combination with a card or paper sleeve fitted, in use, inside the protector so that a transparent portion of at least one of the front and rear faces of the protector enables the sleeve to be viewed through the transparent portion.

4. A corner protector in accordance with claim 1, wherein at least one of said front and rear faces of the protector is selected to be one of the group comprising: ribbed, dimpled, inherently corrugated and just roughened, whereby its frictional grip in use is enhanced.

5. A corner protector according to claim 1, wherein at least one of the front and rear faces is concavely bowed.

6. A corner protector according to claim 1, wherein the corner protector further includes at least one outward projecting portion which may be used by an operator in removing or placing the corner protector on a frame's corner.

7. A corner protector in combination with a card or paper sleeve for carrying at least one of identifying and advertising material, the corner protector having opposite frame-embracing faces, at least one of said opposite frame-embracing faces being resilient and bowed towards the other face so, in use, the corner region of a picture frame must force its way into position between said opposite faces of the protector and thereafter be frictionally gripped between them until the protector is subsequently released by pulling it off against the frictional resistance, wherein at least one of the opposite frame-embracing faces of the protector is at least partially transparent, and wherein the card or paper sleeve is configured to fit inside the protector so that the transparent portion of the protector enables a display face of the sleeve to be viewed, whereby at least one of the identifying and advertising material can be provided on the display face and viewed through the transparent portion.

8. A corner protector in combination with a frame, the corner protector having opposite frame-embracing faces, at least one of said opposite frame-embracing faces being resilient and bowed towards the other face so, in use, the corner region of a picture frame must force its way into position between said opposite faces of the protector and thereafter be frictionally gripped between them until the protector is subsequently released by pulling it off against the frictional resistance, wherein at least one of the opposite frame-embracing faces of the protector has one or more of a protrusion or a recess, or a combination of at least one of each, whereby its frictional grip in use is enhanced, and wherein a surface of the frame at a corner region has one or more of a protrusion or a recess, or a combination of at least one of each, so that, as the protector is pushed onto the frame corner region in use, the one or more of a protrusion or a recess, or a combination of at least one of each, of the protector surface will one of slide and snap into the one or more protrusions or recesses of the frame surface.

9. A corner protector according to claim 8, wherein the one or more of a protrusion or a recess, or a combination of at least one of each, are formed in an edge surface of the frame.

* * * * *